United States Patent [19]

Forman

[11] 4,381,715

[45] May 3, 1983

[54] ADJUSTABLE SHELF MOUNTING SYSTEM

[76] Inventor: David M. Forman, 54 Gaylord Cir., Willingboro, N.J. 08046

[21] Appl. No.: 183,935

[22] Filed: Sep. 4, 1980

[51] Int. Cl.[3] ..... A47B 5/00

[52] U.S. Cl. ..... 108/152; 108/102; 108/108; 108/137; 248/250; 403/329

[58] Field of Search ..... 108/152, 102, 137, 108, 108/134; 312/245, 226; 248/250; 403/167, 397, 329, 407, 330

[56] References Cited

U.S. PATENT DOCUMENTS

| | | | |
|---|---|---|---|
| 173,649 | 2/1876 | Keys | 108/152 |
| 335,931 | 2/1886 | Jacobsen | 248/250 |
| 2,733,887 | 2/1956 | Schmidt | 108/152 X |
| 3,129,819 | 4/1964 | Chandler | 108/152 X |
| 3,177,024 | 4/1965 | Krook et al. | 403/329 X |
| 3,333,555 | 8/1967 | Kapnek | 108/152 |
| 3,403,641 | 10/1968 | Baker | 403/407 |
| 3,527,175 | 9/1970 | Kapnek | 108/152 |
| 3,752,088 | 8/1973 | Kapnek | 108/152 |

FOREIGN PATENT DOCUMENTS

| | | | |
|---|---|---|---|
| 121639 | 6/1948 | Sweden | 403/329 |

*Primary Examiner*—James T. McCall

*Attorney, Agent, or Firm*—Alexis Barron; Charles H. Lindrooth

[57] ABSTRACT

A novel shelf support system which is capable of bearing heavy loads and provides a large measure of adjustability, yet is completely self-contained and only very minimally visible where the shelf meets the wall. The system comprises threaded fasteners for securement to a wall, e.g. at the stud locations, each fastener bearing a support shaft and a spring clip for interengagement with detent grooves which run lengthwise of elongated recessed chambers within the shelf.

8 Claims, 10 Drawing Figures

ADJUSTABLE SHELF MOUNTING SYSTEM

FIELD OF THE INVENTION

This invention relates to a mounting system for the support of shelves or the like and in particular to a system utilizing support hardware which is concealed from view when a shelf is mounted on a wall and which permits adjustment of the shelf along the wall relative to the positions at which the hardware is anchored to the wall.

BACKGROUND OF THE INVENTION

Although there have been prior attempts to provide shelf mounting systems utilizing concealed hardware, these systems have had the limitation that the position of the shelf was dictated by the position of the wall studs into which the hardware was screwed or by the position of the anchoring points if conventional screw anchors were employed. Once the hardware was screwed to the wall, the position of the shelf was fixed and the householder could not shift the shelf to other positions, except by removing and reinstalling the hardware at another point on the wall. Furthermore, with existing known prior art systems, the hardware is not completely hidden, the means for retaining the shelf on the supports being visible in the shelf surface. In the case of some of the prior art systems the retaining means consists of small pins or set screws, which are inconvenient to store or use and are easily lost.

Examples of the prior art attempts are shown in Kapnek U.S. Pats. Nos. 3,333,555; 3,527,175; and 3,752,088, U.S. Pat. No. 3,333,555 discloses a fastener which is screwed into a wall stud and has a shaft protruding from the wall which is inserted into a pre-drilled hole in the shelf. The patent shows a pin dropped through a hole in the shelf to engage a lip on the shaft or a set screw engaging the shaft as the means to retain the shelf on the shaft. Both of the means are easily lost, and a set screw near the back of the shelf is awkward to insert, especially if several shelves are to be mounted one above the other. The greatest drawback to the system shown in that patent, however, is that the position of the shelf on the wall is limited to studs aligned with the predrilled holes.

U.S. Pat. No. 3,527,175 also uses a set screw to retain the shelf, although it is spaced in a somewhat more convenient location, further from the back of the shelf. The system disclosed in that patent attempts to solve the problem of adjusting the location of the shelf by fastening the shaft at any desired point on the wall using screw anchors. However, screw anchors are difficult to remove from the wall, should the user desire to move the shelf. Moreover, once the anchors are fastened to the wall, there is no possibility of shifting the position of the shelf along the wall except by removing and repositioning the anchors.

In both U.S. Pat. Nos. 3,333,555 and 3,527,175 the pins or set screws gave rise to noticeable breaks in the continuity of the upper or lower shelf surface.

U.S. Pat. No. 3,752,088 also provides adjustability of location with screw anchors, but the capability of adjustment is subject to the same limitation as the arrangement of U.S. Pat. No. 3,527,175. Friction is relied on for retaining the shelf on its support.

SUMMARY AND OBJECTS OF THE INVENTION

It is an object of this invention to provide a means for mounting a shelf or the like using a novel form of fastening system which permits lateral adjustment of the position of the shelf with respect to the points of attachment of the fasteners to the wall. An advantage of the arrangement is that the fasteners may be secured at points where the wall is strongest, as where studs exist and the shelf may be shifted lengthwise of these anchor points to another location on the wall as desired by the installer.

It is also an object of this invention to provide a shelf support system which is hidden, yet capable of bearing a load.

It is a further object of this invention to provide, in such a shelf support system, a self-contained means for retaining the shelf on the supports.

A still further object of the invention is the provision of a shelf support system which facilitates mounting of the shelf on irregular or uneven wall surfaces.

These and other related objects and advantages of the invention are accomplished by a fastener system including a fastener member having one end adapted to be anchored within a wall and a shaft extending therefrom. Each shaft fits within and is concealed by a chamber recessed within and extending lengthwise of the shelf. Retaining means, including a spring clip and detent means running lengthwise of the chamber retain the shelf upon the supports while permitting lengthwise relative movement of the shelf with respect to the support structure.

BRIEF DESCRIPTION OF THE DRAWINGS

In the accompanying drawings:

FIG. 8 is a cross-sectional view of a shelf partly mounted on the fastener which is mounted in a wall.

DETAILED DESCRIPTION OF PREFERRED EMBODIMENT

Figure 1:
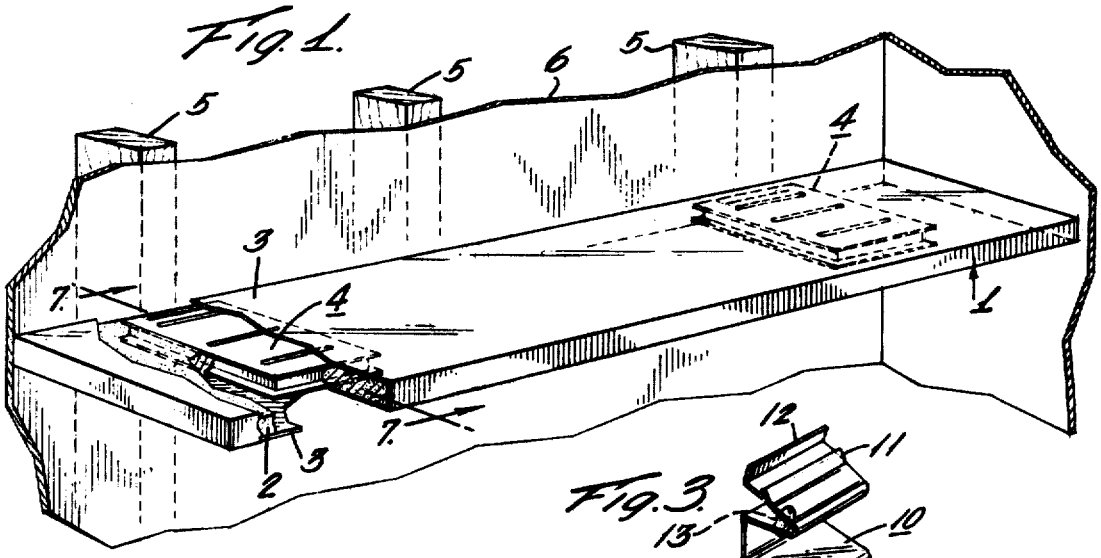
FIG. 1 is an overall view of a shelf on a wall showing the wall studs and the elongated recessed chambers in the shelf.

With reference to the drawings, although other means of construction may be employed, shelf 1 is conveniently formed as a laminate composed of core material 2 covered with upper and lower laminae 3. Laminae 3 can be wood veneer, plastic, or other finishing materials. Recessed within the confines of the laminae 3 are one or more elongated chambers 4 described more particularly hereinafter. The chambers preferably are positioned so as to correspond to locations of wall studs 5, which are commonly on 16-inch centers. As represented in FIG. 1, for purposes of illustration only, shelf 1 is approximately 3 feet long, and has two chambers 4 mounted near its ends, each chamber having a length in its dimension extending along the wall which is several times the width of a typical stud. In the shelf illustrated, a third chamber may be provided in the center; in any given shelf it may be advantageous to have a chamber every 16 inches in case the pattern of wall studs is interrupted or changes near an end of the shelf or if more support is needed. The elongation of the chambers in their dimension extending lengthwise of the shelf allows the shelf to be positioned off-center with respect to stud positions, if desired, while still utilizing the studs for support. For example, the shelf could be supported from a pair of studs adjacent to a corner, and the shelf then slid all the way into the corner. An advantageous construction is to have one continuous chamber along the entire length of the shelf so as to permit maximum adjustability.

Figure 2:
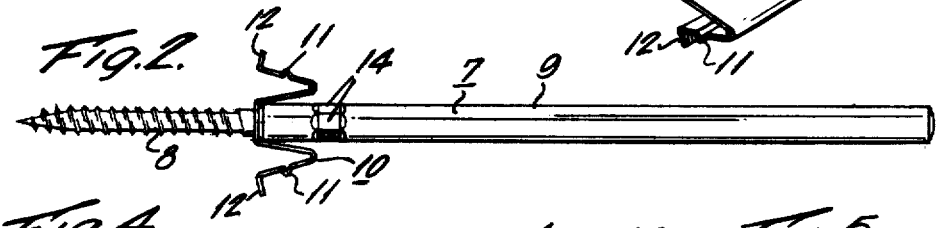
FIG. 2 is a side view of a preferred form of fastener incorporating the principles of the invention.
Figures 7, 8, 9, 10:
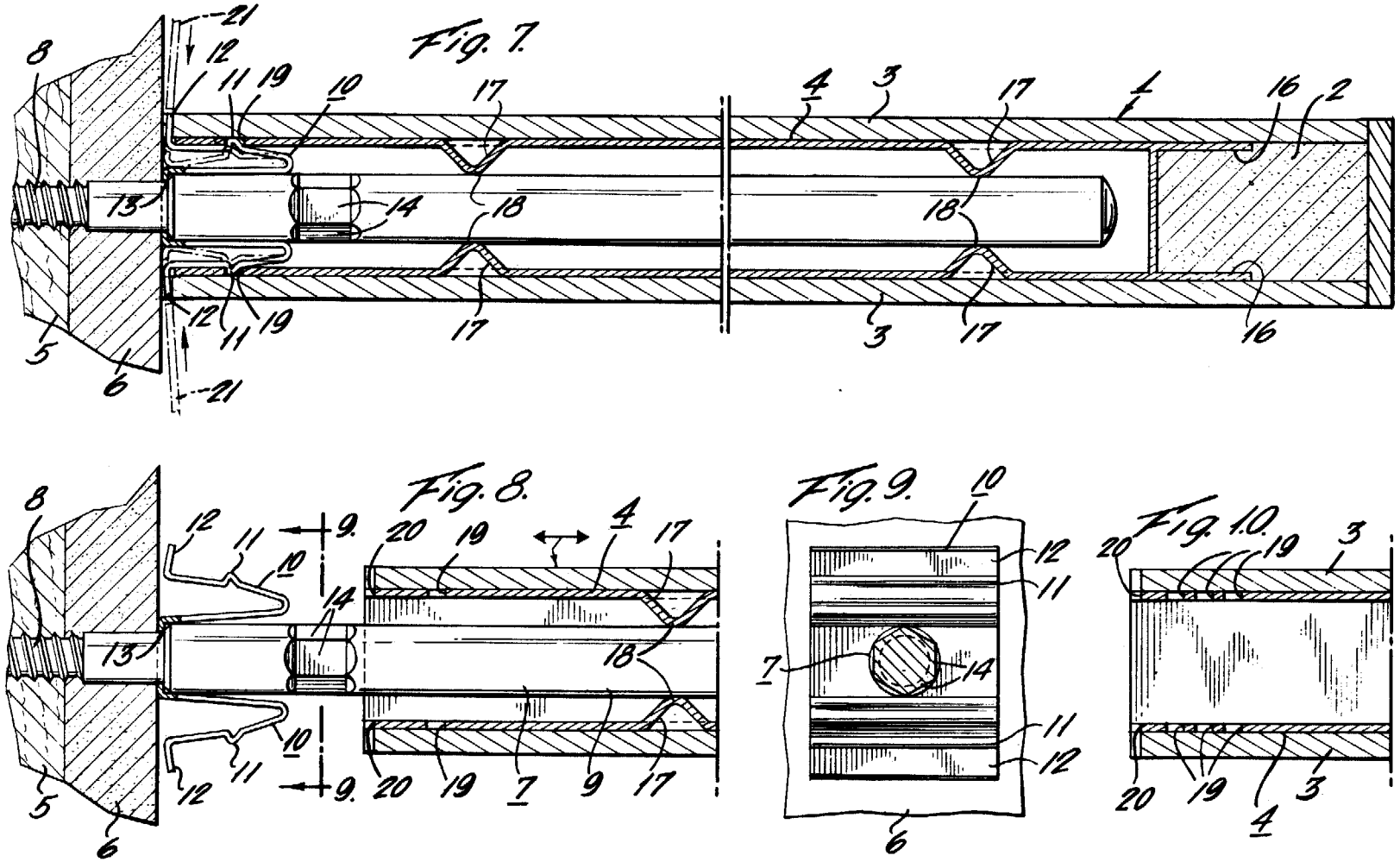
FIG. 8 is a cross-sectional view of the chamber taken along line 6—6 of FIG. 4.
FIG. 7 is a cross-sectional view of the fastener of FIG. 2 mounted in a wall, with a shelf mounted on the fastener, taken along line 7—7 of FIG. 1.
FIG. 9 is a cross-sectional view of the fastener taken along line 9—9 of FIG. 8.
FIG. 10 is a fragmentary cross-sectional view of an alternate arrangement of the chamber.

The support means for anchoring the shelf on a wall 6 preferably comprises a plurality of fasteners 7 which are secured into the wall and then inserted into the chambers 4. As shown in FIG. 2, 7 and 8, each fastener 7 has a threaded end 8 which is used to secure the fastener into the wall, as for example at stud 5. If wall 2 is of masonry, and therefore without studs, a lead sinker (not shown) can be inserted into the wall screwed into it. If desired, an expandable fastener may be employed. Shaft 9 extends outwardly from threaded end 8 and is used to carry the load. The entire fastener is made extremely strong so that it will not bend under the weight of the shelf or its contents.

Figure 3:
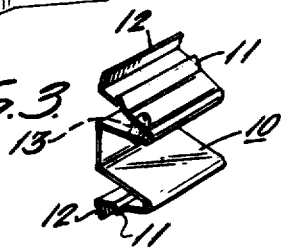
FIG. 3 is an isometric view of the spring clip utilized with the fastener of FIG. 2.

Releasable locking means comprising spring clip 10, is supported on shaft 9. Preferably the spring clip has a double-V shape and is positioned on the fastener at the point where threaded end 8 meets shaft 9. Each "V" of the clip has a projection or ridge 11 and a lip 12, best shown in FIGS. 2 and 3, whose functions will be described in detail below. The clip 10 is provided with a central hole 13 by means of which it is axially mounted on fastener 7. Spaced outwardly from clip 10, shaft 9 preferably has multiple flattened surfaces 14 which are designed to receive a wrench, to be used in securing fastener 7 to wall stud 5.

Figure 4:
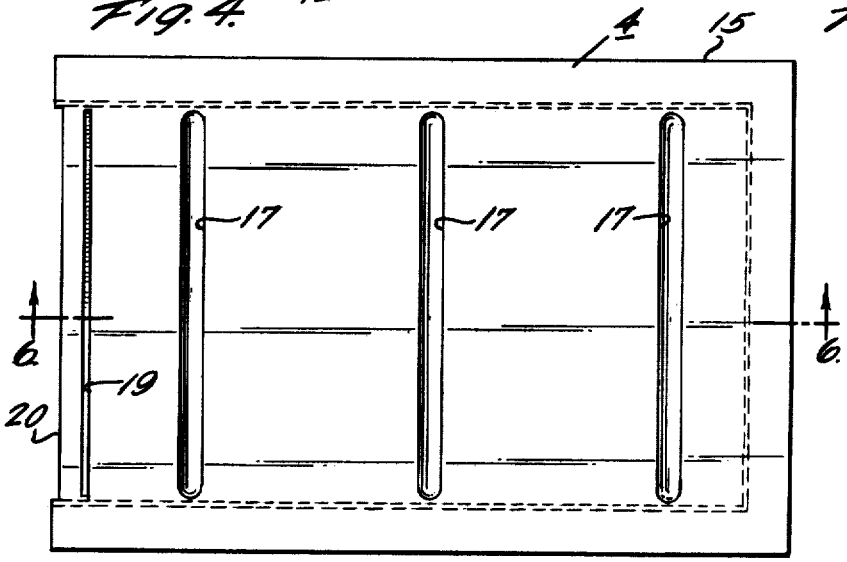
FIG. 4 is a top view of a chamber of the kind shown in FIG. 1.
Figure 5:
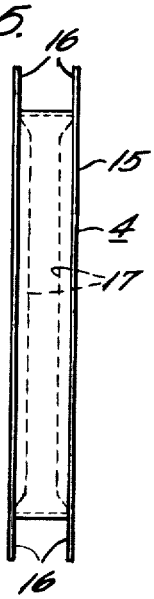
FIG 5 is an end view of the chamber taken along line 5—5 of FIG. 4.
Figure 6:
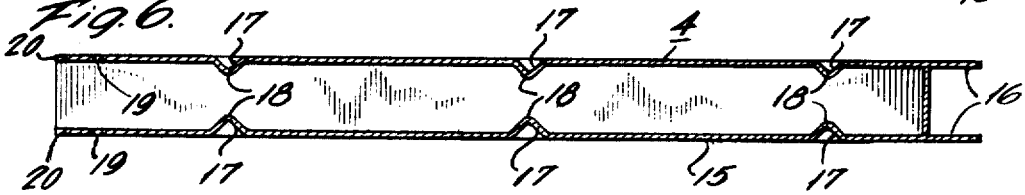

Although each chamber could be routed out of a solid shell or otherwise formed integrally with the shelf, it is preferred that each chamber be a separate component sandwiched between the laminae 3. One such chamber 4 is shown in detail in FIGS. 4 through 6. It is fabricated from sheeting 15, preferably metal, but any other material can be used. Transverse ribs 17 protrude into the chamber and are dimensioned so that their crests 18 bear against the periphery of shaft 9 with a snug fit. The ribs not only provide stiffness for the hollow part of the shelf and guidance for the shafts when they are inserted, but they also allow room for the flexing of spring clip 10. Overhangs 16 extend beyond the boundaries of chamber 4 to embrace core material 2, thereby strengthening a potential weak point in the shelf that would otherwise exist at the boundaries of the chamber 4. Grooves 19, preferably located in aligned relationship in the upper and lower surfaces of the chamber provide a detent means for interenegagement with ridge 11 of spring clip 10, by means of which the shelf is retained on shaft 9. Preferably the detent grooves extend lengthwise of each chamber 4. The use of the continuous detent grooves in conjunction with a spring clip constitutes an important part of the adjustability feature of the invention in that it eliminates the need for set screw or pin holes in specific locations which would otherwise limit adjustability. As best shown in FIGS. 4, 7 and 8, the edge of the chamber adjacent the wall is preferably provided with a shallow recess 20. Recess 20 accepts lips 12 of clip 10 so that lips 12 do not project beyond the rear boundaries of the shelf and prevent the shelf from seating flush against wall 6.

FIG. 7 shows a cross-sectional view of shelf 1 mounted on shaft 9 of fastener 7 which is screwed into a wall stud 5. Ridges 11 of the spring clip 10 are engaged in the detent grooves 19. As can be seen in FIG. 7, lips 12 project upwardly and downwardly within the recesses 20 so that their ends may be depressed by use of a putty knife or other similar instrument 21, to release ridges 11 from grooves 19, as shown, thereby freeing the shelf as illustrated in FIG. 8 where the two-way arrow indicates free movement of the shelf. Thus releasability is achieved, without interrupting the shelf surface for set screws or pins, with just a small widening of the crack that would in any event be present where the shelf meets the wall, and the exposure of lips 12 in that crack.

FIG. 10 shows a detent configuration with three grooves 19 instead of one. By having three grooves, the detent means is more adaptable to irregularities in the wall surface which might prevent the ridges of all the fasteners being used from simultaneously seating themselves in one groove.

From the foregoing description it will be understood that my shelf support system provides a load-bearing, adjustable and yet invisible means of supporting a shelf or like object. Further it is seen that the means for retaining the shelf on the support means is contained in the support means so that it cannot be misplaced. The retaining means are also seen to be concealed for all practical purposes. All of the above described features are present, providing a strong, simple, easy-to-use system.

I claim:

1. A wall mounting system for an elongated member with at least one hollow interior chamber having an opening on the side abutting a wall, said opening extending lengthwise of the elongated member, a detent means within the chamber running substantially lengthwise thereof, at least one elongated fastener member having on one end means for rigid securement to the wall and the other end projecting perpendicularly from the wall and spring means associated with said portion of said fastener extending perpendicularly from the wall, said spring means comprising a releasable locking portion biased radially outwardly from the fastener for interengagement with said detent means at selected positions lengthwise thereof.

2. A mounting system according to claim 1 wherein said detent means comprises at least one elongated groove running lengthwise of said chamber and parallel to the wall, wherein said spring means comprises a leaf spring connected to said elongated fastener member and having a projection biased outwardly from the fastener member and dimensioned to fit within a groove of said detent means to hold the member in locked position.

3. A mounting system according to claim 1 wherein said detent means comprises at least one elongated groove running lengthwise of said chamber and parallel to the wall, wherein said spring means comprises a spring clip axially mounted on said fastener member and having a projection biased outwardly from the fastener member and dimensioned to fit within a groove of said detent means to hold the shelf in locked position.

4. A mounting system according to claim 3, wherein said detent means comprises at least one lengthwise groove on each of the upper and lower surfaces of said chamber and wherein said spring clip comprises a pair of V-shaped spring arms mounted at the base of said other end of the fastener member and biased away from the surface thereof, each spring arm having a projection extending outwardly with respect to the fastener member and being adapted to fit within said lengthwise grooves for locking said shelf on said fastener member.

5. A system according to claim 4 further including openings to the interior of said chamber at ther rear of the upper and lower surface for access to said spring means for movement of the projections on the spring arms out of said detent grooves.

6. A system according to claim 5 wherein said detent means comprises a plurality of lengthwise grooves on each of the upper and lower surfaces of said chamber.

7. A system according to claim 1 wherein the end of said elongated fastener member for securement to the wall is provided with threads for fastening said member to a wall and a portion with multiple flattened sides adjacent the threaded portion, said flattened sides adapted to receive wrench means used to secure the threaded portion to the wall.

8. A system according to claim 2 further including an opening to the interior of said chamber for access to said leaf spring for movement of the projection out of said detent groove.

* * * * *